US005177839A

United States Patent [19]

Seto

[11] Patent Number: 5,177,839

[45] Date of Patent: Jan. 12, 1993

[54] BUCKLE FOR SEAT BELT

[75] Inventor: Toshiaki Seto, Fujisawa, Japan

[73] Assignee: NSK Ltd., Tokyo, Japan

[21] Appl. No.: 824,609

[22] Filed: Jan. 23, 1992

[30] Foreign Application Priority Data

Feb. 1, 1991 [JP] Japan ..... 3-009160[U]

[51] Int. Cl.[5] ..... A44B 11/25

[52] U.S. Cl. ..... 24/641; 24/637; 24/643

[58] Field of Search ..... 24/641, 637, 643; 297/468

[56] References Cited

U.S. PATENT DOCUMENTS 4,428,103 1/1984 Wier .
4,454,634 6/1984 Haglund et al. ..... 24/641
4,562,625 1/1986 Doty et al. .
4,642,858 2/1987 Ishiguro et al. .
4,733,444 3/1988 Takada ..... 24/645
4,754,105 6/1988 Doty et al. .
4,802,266 2/1989 Doty et al. .
4,870,726 10/1989 Eksell et al. ..... 24/643
4,920,620 5/1990 Yamamoto et al. .
5,014,401 5/1991 Kitazawa ..... 24/641

FOREIGN PATENT DOCUMENTS 134306 8/1986 Japan .
153511 9/1986 Japan .
2054727 2/1981 United Kingdom .

*Primary Examiner*—Victor N. Sakran
*Attorney, Agent, or Firm*—Helfgott & Karas

[57] ABSTRACT

A seat belt buckle is disclosed in which play between a buckle base and a buckle button caused by vibration during the operation of an automobile is prevented, so that the tips of a pair of arm leaves formed on the buckle button are elastically pressed against the outer surfaces of a pair of upright plates on the buckle base to prevent lateral play between the buckle base and the buckle button, while vertical play is prevented by the elastic pressure from the tips of another pair of arm leaves against the upright plates.

4 Claims, 5 Drawing Sheets

BUCKLE FOR SEAT BELT

BACKGROUND OF THE INVENTION

1. Field of the Invention

The present invention relates to a seat belt buckle, and in particular, to an improved structure for a buckle incorporated in a seat belt which is provided on the seat of an automobile for protecting a passenger in the event of a collision.

2. Description of the Prior Art

Conventionally, a seat belt as illustrated in FIG. 6 is provided on the seat of an automobile for protecting a passenger in the event of an accident such as a collision.

The seat belt has a webbing 1 which is a restraining member on one side, and a flexible wire 3 which is a restraining member on the other side.

A tongue plate 2 engaged with the webbing 1 and a buckle 4 engaged with the flexible wire 3 are matingly engaged when the seat belt is used.

When an impact occurs, a passenger seated in a seat 5 is prevented from being catapulted in the forward direction by the linkage of the two restraining members 1, 3.

When alighting from the vehicle, the linkage of the buckle 4 and the tongue plate 2 is released by pressing a metal buckle button on the buckle 4. As a result, the restraining members 1, 3 do not obstruct the passenger when quitting the seat.

Simplification of the action of engaging and disengaging the buckle 4 and the tongue plate 2 is necessary to allow smooth entry to and quit from the automobile. Accordingly various types of buckles for seat belts are known conventionally, such as those disclosed in Japanese Laid-Open Utility Model Applications 61-134306 and No. 61-153511.

The structure of this type of conventionally known buckle 4 is illustrated in FIG. 7 to FIG. 9. Some parts of the buckle shown in FIG. 7 differ in shape slightly from parts of the buckle as shown in FIG. 8 and FIG. 9. However, these points of difference bear no relation whatsoever to the essential features of the present invention.

A buckle base 8 is fabricated by bending a metal plate with adequate rigidity, such as a steel plate or the like, into a U-shape in cross-section. The buckle base 8 is maintained inside a space enclosed by an upper cover 6 and a lower cover 7. The buckle base 8 has a flat base plate 9 maintained in a position immediately above the lower cover 7, and a pair of plates 10, 10 bent upright from the flat base plate 9. The upright plates 10, 10 are erected at right angles to the base plate 9 at the edges of the two side sections of the base plate 9. In addition, one end of the flexible wire 3 (see FIG. 6), which acts as a restraining member, is linked to one end of the buckle base 8.

A buckle latch piece 11 forms a latching and unlatching mechanism for engaging the buckle base 8 of the buckle 4 with the tongue plate 2. The buckle latch piece 11 has a depending hook leaf 12 on its front end (closer to the tip of the buckle 4, the left side in FIG. 7 to FIG. 9), a pair of projecting leaves 13, 13 on its rear end (on the right side in FIG. 7 to FIG. 9), and a pair of bent leaves 26, 26 on its lateral sides. The projecting leaves 13, 13 project from each of the two sides in a width direction laterally, and the pair of bent leaves 26, 26 project downward from the buckle latch piece 11, respectively.

The projecting leaves 13, 13 are inserted into a pair of first through-holes 14, 14 formed in the upright plates 10, 10, respectively, so that the buckle latch piece 11 is supported by and between the upright plates 10, 10 and freely pivoted or swung around its rear secion.

A lock plate 15 is provided on the latch piece 11 and has the role of maintaining the buckle latch piece 11 in the lock position (the position in which the hook leaf 12 is adjacent to the base plate 9 of the buckle base 8), until the passenger operates a buckle button 18 (later described). The two sides of the lock plate 15 are inserted into a pair of second through-holes 16, 16 formed in the upright plates 10, 10, respectively, in a manner which allows a certain amount of free vertical and lateral displacement of the lock plate 15. A lock plate spring 17, which is a compression spring, is provided between the rear edge of the lock plate 15 and the buckle latch piece 11. The lock plate spring 17 applies an elastic force against the lock plate 15 in the forward direction.

A push-out spring 21, which is a compression spring, is provided between a buckle slider 19 and an engaging section 20 formed on the base plate 9 of the buckle base 8. The push-out spring 21 applies an elastic force against the buckle slider 19, always in the forward direction.

The buckle button 18 moves freely in the longitudinal or front-rear direction between the lower surface of the upper cover 6 and the upper edges of the upright plates 10, 10 of the buckle base 8. A button spring 24, which is a tension spring, is provided between an engaging section 22 at the rear end of the buckle button 18 and an engaging section 23 at the front of the buckle latch piece 11. The button spring 24 contributes an elastic force to the buckle button 18 in the forward direction, and an elastic force to the buckle latch piece 11 to rotate the buckle latch piece 11 in the clockwise direction of FIG. 9.

When the buckle 4 and the tongue plate 2 are to be connected, the passenger presses a tip section **2*a* of the tongue plate 2 into a slot-shaped aperture 25 (FIG. 9) between the lower edge of the buckle button 18 and the upper surface of the base plate 9 of the buckle base 8. The passenger then presses the buckle slider 19 against the elastic force of the push out spring 21 to the rear (to the right in FIG. 7 to FIG. 9**).

As the buckle slider 19 moves toward the rear, a rear surface **19*a* of the buckle slider 19 presses a pair of bent leaves 26, 26, to the rear. This causes the buckle latch piece 11 to pivot in the counterclockwise direction in FIG. 9, around its rear section (the section where the first through-holes 14, 14 are engaged with the projecting leaves 13, 13) opposed to the elastic force of the button spring 24. As a result, the hook leaf 12 formed at the front end of the buckle latch piece 11 enters an opening 28 formed in the tip section 2*a* of the tongue plate 2. The tongue plate 2 and the buckle 4** are thus connected with each other and cannot be separated while in this state.

A notched groove 27 formed in the center of the lock plate 15 is engaged with a jaw section of the engaging section 23. This causes the lock plate 15 to combine with the buckle latch piece 11 to freely slide in the direction of their surfaces only. Therefore, as the buckle latch piece 11 pivots or swings, the lock plate 15 pivots or swings in the same direction as the buckle latch piece 11 (counterclockwise in FIG. 9). As a result, the lock plate 15 is pressed by the elastic force of the lock plate spring 17 into a pair of narrow sections **16*a*, 16*a* formed in the front side of the second through-holes 16, 16. The lock plate 15 is stable when pressed into the narrow sections 16***a*, 16*a*. The lock plate 15 then prevents the upward movement of the front end of the buckle latch piece 11. As a result, the engagement of the hook leaf 12 of the buckle latch piece 11 with the opening 28 in the tongue plate 2 cannot be inadvertently released.

To release the engagement of the buckle 4 with the tongue plate 2, the passenger presses the buckle button 18 into the upper cover 6 against the elastic force of the button spring 24. The passenger then pushes the lock plate 15 to the rear from a rear surface 18*a* (FIG. 9) of the side wall section formed in the buckle button 18.

As a result, both sides of the end section of the lock plate 15 are disengaged from the narrow sections 16*a*, 16*a* of the second through-holes 16, 16 and moved to a pair of wide sections 16*b*, 16*b* which are continuation of the narrow sections 16*a*, 16*a* on the rear side thereof. This makes it possible to move the lock plate 15 upward, so that the buckle latch piece 11 freely pivoted or swung in the clockwise direction in FIG. 9 around the axis where the projecting leaves 13, 13 are engaged with the first through holes 14, 14. The buckle latch piece 11 is then pivoted or swung in the clockwise direction in FIG. 9 by the elastic force of the button spring 24. This results in the hook leaf 12 formed on the front end of the buckle latch piece 11 being extracted from the opening 28 of the tongue plate 2. The tongue plate 2 and the buckle 4 then become freely separable in this state.

In this conventional seat belt buckle, the buckle button 18 for disengaging the tongue plate 2 and the buckle 4 is mounted to the buckle base 8 such that it is freely displaced to some extent with respect to the buckle base 8. Because of this, a slight gap exists between the buckle base 8 and the buckle button 18, which results in a tendency for play to occur between the buckle base 8 and the buckle button 18 from the movement and vibration of the vehicle. A discordant noise is produced from play in the buckle button 18, which causes some discomfort to the passenger.

The play between the buckle button 18 and the buckle base 8 could be eliminated in spite of the existence of the slight gap mentioned above by providing a button spring 24 with strong elastic force which puts tension on the buckle button 18. However, considerable force must be required against the button spring 24 to release the buckle 4 and the tongue plate 2, which is not desirable. This is a drawback when there is a strong elastic force in the button spring 24.

SUMMARY OF THE INVENTION

An object of the present invention is to provide, with due consideration to the drawbacks of such conventional devices, a seat belt buckle wherein an elastic, freely deformable arm leaf is integrally formed on one part of a buckle button so that play between the buckle button and the buckle base can be prevented by elastically pressing the front end of the arm leaf against part of the buckle base.

BRIEF DESCRIPTION OF ACCOMPANYING DRAWINGS

DETAILED DESCRIPTION OF THE PREFERRED EMBODIMENTS

An embodiment of the present invention will now be explained with reference to the drawings.

Figure 1:
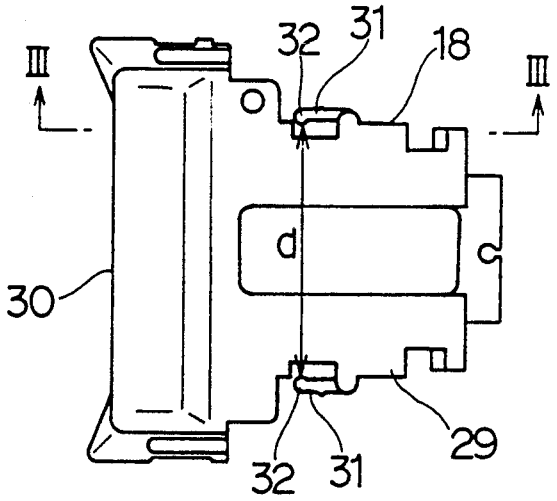
FIG. 1 is a plan view of a buckle button to be assembled into a seat belt buckle of the present invention.
Figure 2:
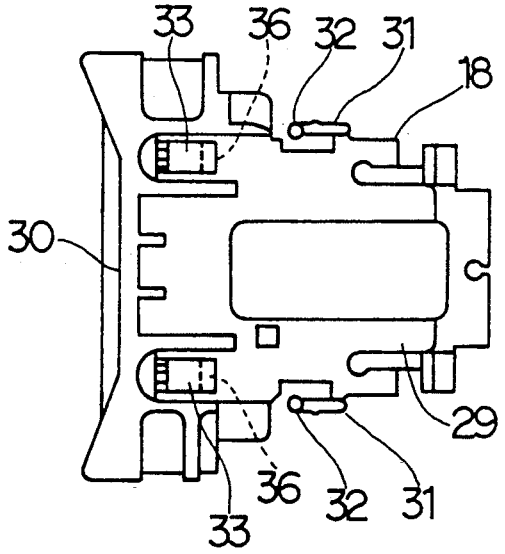
FIG. 2 is a bottom view of the buckle button of FIG. 1.
Figure 3:
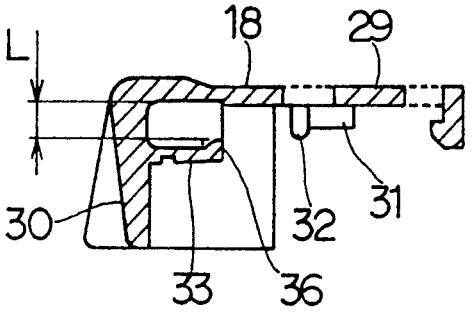
FIG. 3 is a cross sectional view taken along the line III—III in FIG. 1.
Figure 4:
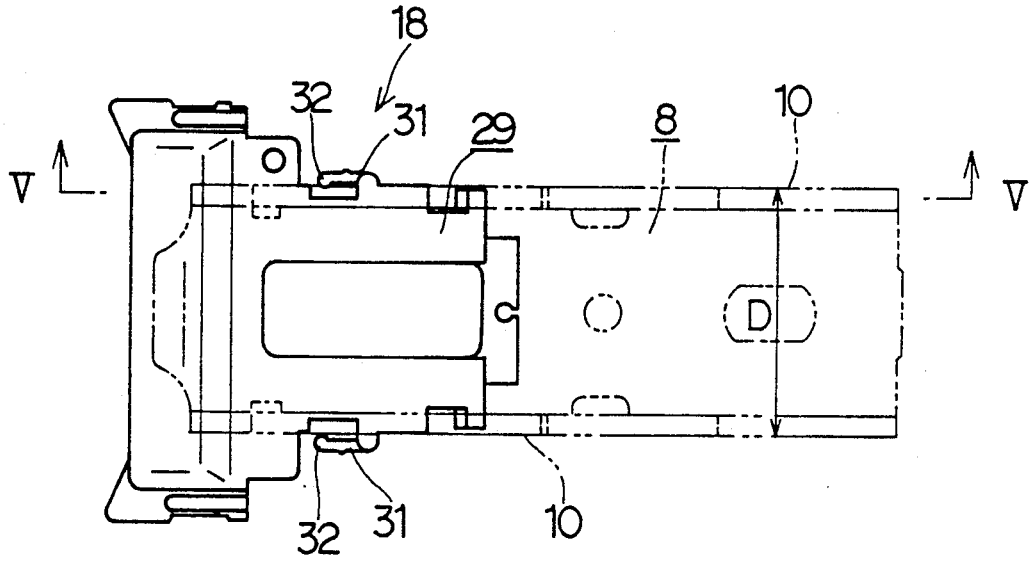
FIG. 4 is a plan view showing the buckle button combined with a buckle base.
Figure 5:
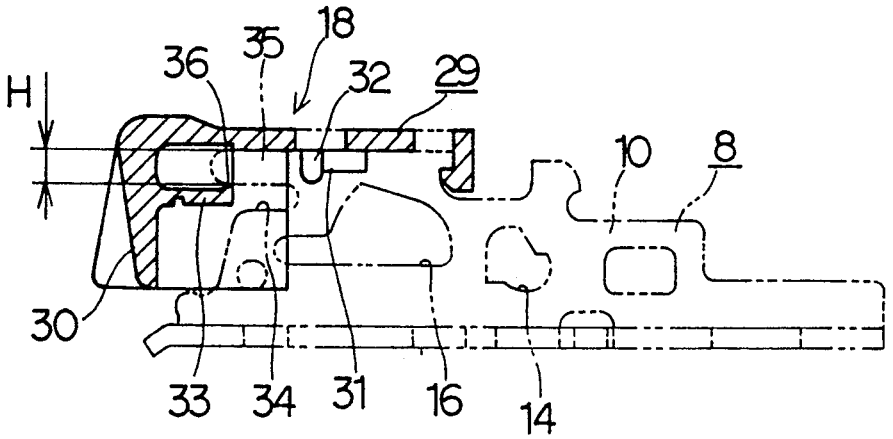
FIG. 5 is a cross sectional view taken along the line V—V in FIG. 4.
Figure 6:
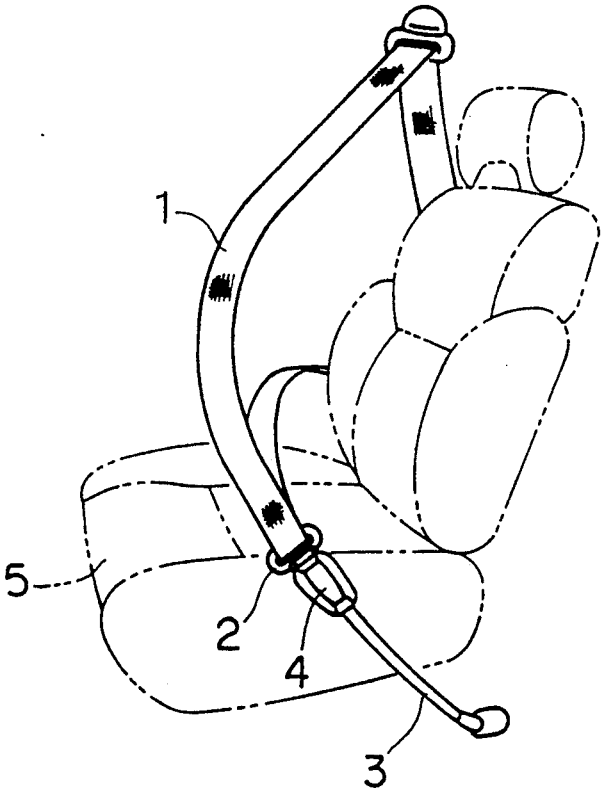
FIG. 6 is a perspective view showing the whole structure of the seat belt.

FIG. 1 to 5 show an embodiment of the present invention. In FIGS. 4 and 5, phantom lines are used to make clear the relation between the buckle button 18 and the buckle base 8.

A buckle button 18 is integrally fabricated by injection molding from a synthetic resin with elastic characteristics. The buckle button 18 comprises a base plate 29 and a depending wall section 30 provided at the front end of the base plate 29.

A pair of arm leaves 31, 31 are formed on the two lateral side edges at the midway section of the base plate 29. The base end sections of the arm leaves 31, 31 are connected to the base plate 29 of the arm leaves 31, 31, so that the arm leaves 31, 31 are in a cantilever manner supported by the base plate 29. Enlarged sections 32, 32 are formed at the front ends of the arm leaves 31, 31. The space d between the enlarged sections 32, 32 of the arm leaves 31, 31 is a little narrower than the space of the other sections of the arm leaves 31, 31. In addition, the space d between the enlarged sections 32, 32 in a free state is slightly smaller than the space D (see FIG. 4) between the outer surfaces of a pair of upright plates 10, 10 which form a buckle base 8 (specifically, $d<D$).

Figure 7:
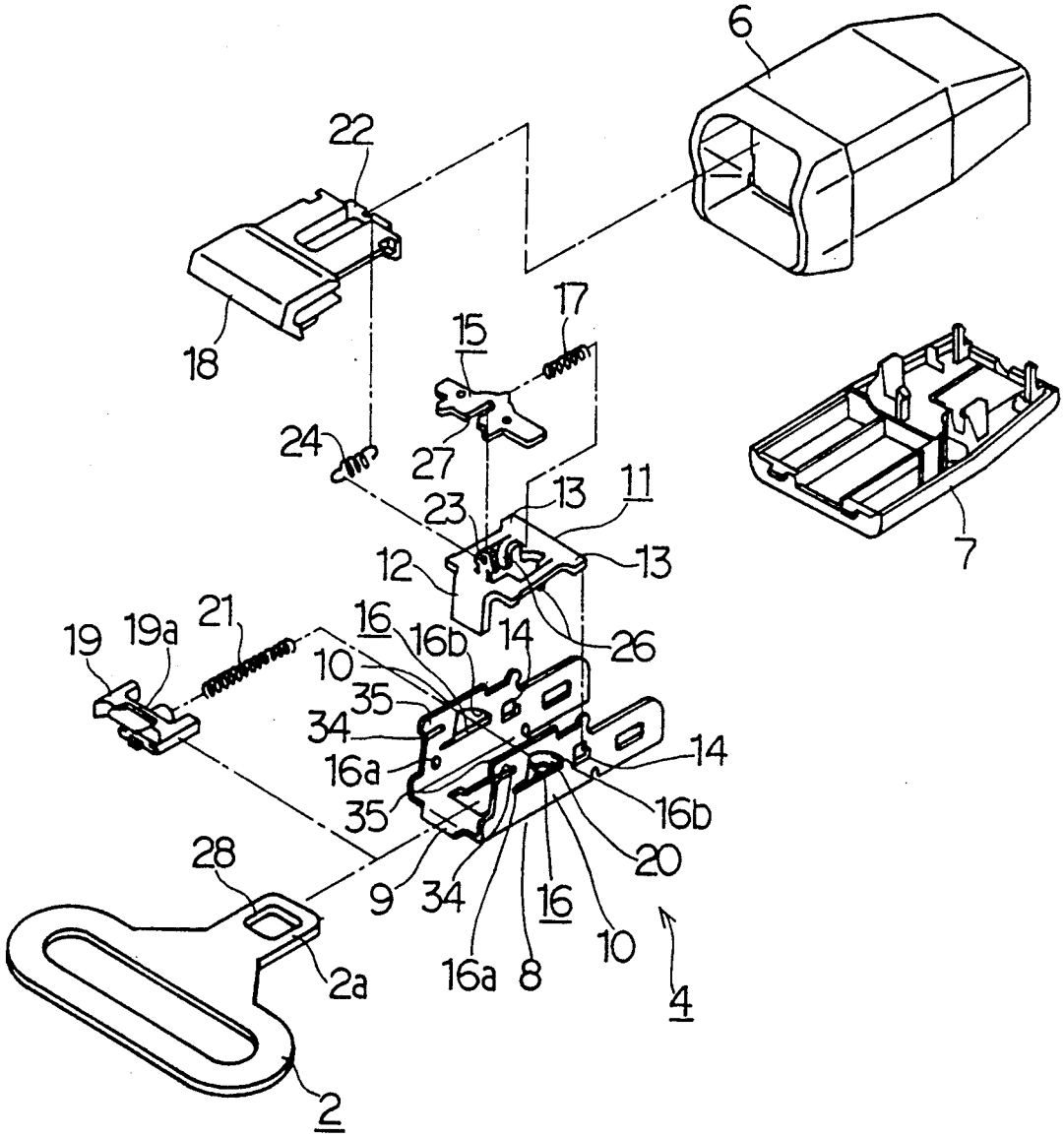
FIG. 7 PRIOR ART
FIG. 7 is an exploded perspective view showing one example of a conventional seat belt buckle.

A pair of arm leaves 33, 33 is provided in a cantilever manner in two locations at the left and right of the rear surface of the depending wall section 30 and at a position where the arm leaves 33, 33 are aligned with the pair of upright plates 10, 10. An enlarged section 36 is formed on the upper surface at the tip end of each of the arm leaves 33, 33. In addition, as shown in FIG. 5 and FIG. 7, a pair of U-shaped notches 34, 34 cut into the front edge of the upright plates 10, 10, respectively. A projecting plate 35 is formed on the upper part of the front edge of one of the upright plates 10, 10 by means of the notches 34, 34, respectively. The distance L between the enlarged section 36 and the lower surface of the base plate 29 in the free state is slightly smaller than the height H of the projecting plates 35, 35 (that is, $L<H$).

Figure 8:
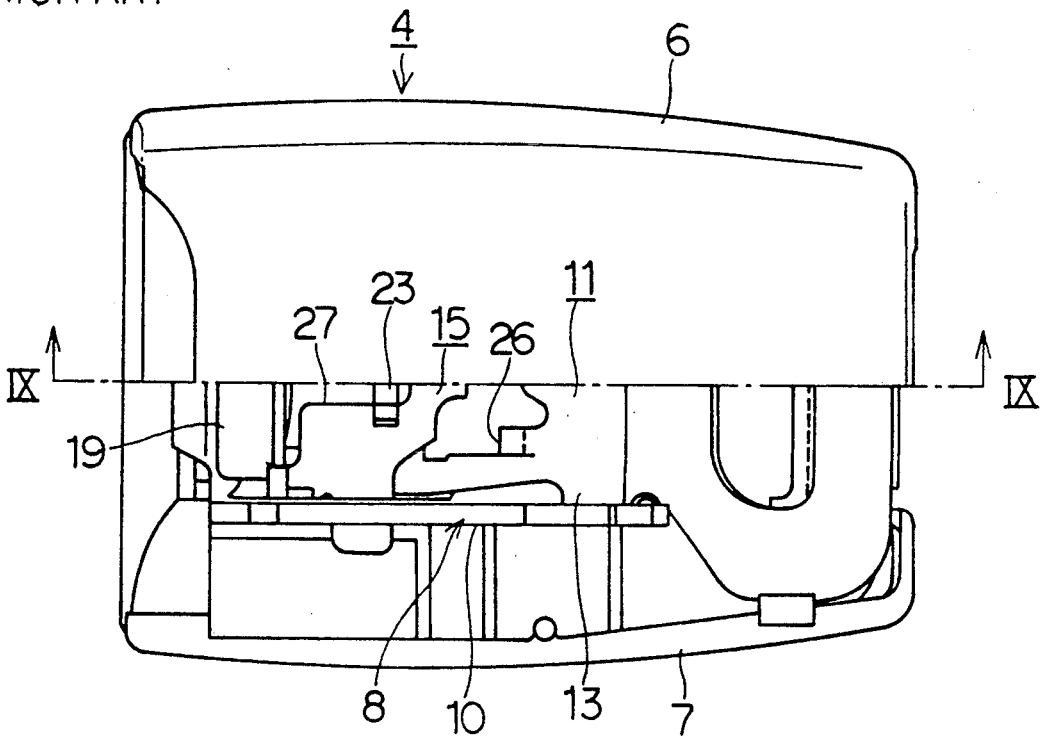
FIG. 8 PRIOR ART
FIG. 8 is a plan view showing the assembled conventional seat belt buckle of FIG. 7 with one part of the upper cover removed.
Figure 9:
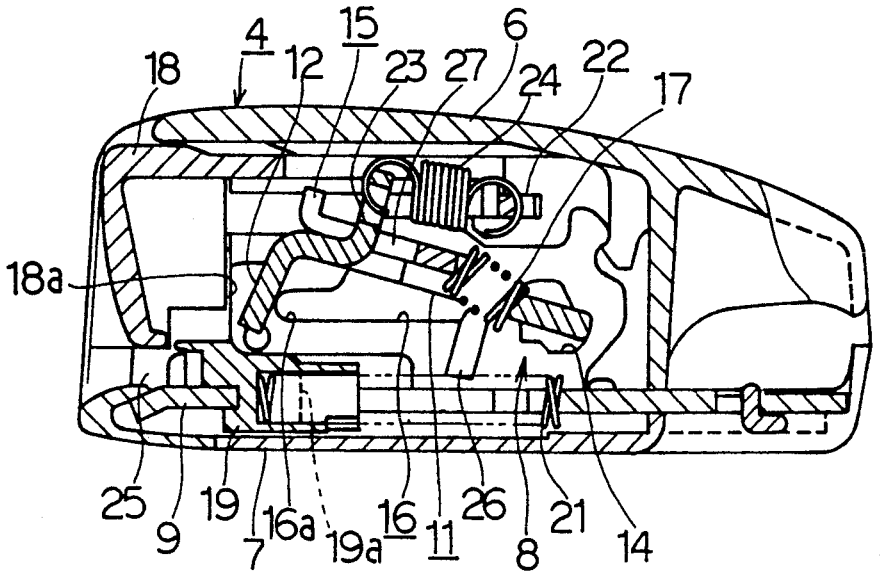
FIG. 9 PRIOR ART
FIG. 9 is a sectional view along the section IX—IX in FIG. 8.

The buckle base 8 and the buckle button 18 form a seat belt buckle, combined with other parts in the same manner as for the conventional seat belt buckle as illustrated in FIG. 7 to FIG. 9. The enlarged sections 32, 32 at the front ends of the arm leaves 31, 31 are elastically pressed against the outer surface of the pair of the upright plates 10, 10 as shown in FIG. 4 in a condition that the buckle base 8 is combined with the buckle button 18 as shown in FIGS. 4 and 5. In addition, the enlarged sections 36, 36 at the tip ends of the arm leaves 33, 33 are elastically pressed against the lower edge of the projection plate 35, as shown in FIG. 5.

The passenger latches or unlatches the buckle 4 and the tongue plate 2 (see FIG. 7) of the seat belt buckle of the present invention formed as outlined above, in the same manner as in the case of the conventional seat belt buckle.

In particular, in the case of the seat belt buckle of the present invention, the tip ends of the arm leaves 31, 33 formed on the buckle button 18 are elastically pressed against the corresponding part of the buckle base 8 at these portions. For this reason, there is no space between the buckle button 18 and the buckle base 8. As a result, play between the buckle button 18 and the buckle base 8 is reliably prevented. There is therefore no discordant noise nor vibration produced from the operation of the automobile.

The gap in the direction of the width disappears because the enlarged sections 32, 32 on the tip end of the pair of arm leaves 31, 31 formed on the base plate 29 of the buckle button 18 are elastically pressed against the outer surface of the upright plates 10, 10 of the buckle base 8. As a result, there is no play in a width direction between the buckle button 18 and the buckle base 8.

In addition, the gap in the vertical direction disappears because the enlarged sections 36, 36 on the front end of the pair of arm leaves 33, 33 formed on the rear surface of the depending wall section 30 are elastically pressed against the lower edge of the projecting plates 35, 35 of the upright plates 10, 10. As a result, there is no play in a vertical direction between the buckle button 18 and the buckle base 8.

Therefore, it will be noted that there is no play between the buckle button 18 and the buckle 8 in both of the vertical and lateral directions. Then, when the buckle vibrates from the operation of the automobile, no discordant noise or vibration is produced as the result of play between the buckle button 18 and the buckle base 8.

Play between the buckle button and the buckle base can be reliably prevented with the seat belt buckle of the present invention without a larger pressure to displace the buckle button and without the number of parts increased. For this reason, it is possible to provide, at low cost, a seat belt buckle which causes no discomfort to the passenger and is easily operated.

What is claimed is:

1. A seat belt buckle for use in a first restraining member for forming a seat belt to be combined with a tongue plate engaged with a second restraining member, comprising:

a buckle base formed of a metal plate supported by the first restraining member;

an engaging and disengaging mechanism supported on the buckle base to be engaged with and disengaged from the tongue plate;

a synthetic resin buckle button which is engaged with the buckle base in a freely displaceable manner for engaging said mechanism with and disengaging said mechanism from the tongue plate as the buckle button is displaced; and an arm leaf means integrally formed with a part of the buckle button;

the arm leaf means being formed so that it elastically presses against a part of the buckle base such that a play between the buckle button and the buckle base is prevented.

2. A seat belt buckle as claimed in claim 1, wherein the arm leaf means is comprised of a pair of elastically deformable arm leaves having tip ends opposed to each other, an upright plate having an outer surface being provided on either side of the buckle base, and a tip end of each arm leaf being elastically pressed against the outer surface of the respective upright plate, so that a lateral play is prevented between the buckle button and the buckle base.

3. A seat belt buckle as claimed in claim 2, wherein each upright plate further has an upper front edge, so that a notch is formed in the upper front edge of the upright plate to form a projecting plate having a lower edge, the buckle button having a front end and a depending wall section formed on the front end, so that the pair of arm leaves are formed on the depending wall section, whereby a vertical play between the buckle button and the buckle base is prevented by elastically pressing the tip end of each of the pair of arm leaves on the lower edge of the respective projecting plate.

4. A seat belt buckle as claimed in claim 1, wherein the arm leaf means is comprised of a pair of elastically deformable arm leaves having tip ends, an upright plate having an upper front edge being provided on either side of the buckle base, so that a notch is formed in the upper front edge of the upright plate to form a projecting plate having a lower edge in the upper front edge of the upright plate, the buckle button having a front end and a depending wall section formed on the front end, so that the pair of arm leaves are formed on the depending wall, whereby a vertical play between the buckle button and the buckle base is prevented by elastically pressing a tip end of each of the pair of arm leaves on the lower edge of the projecting plate.

* * * * *